US006435316B1

(12) United States Patent
Ando

(10) Patent No.: US 6,435,316 B1
(45) Date of Patent: Aug. 20, 2002

(54) ROPE SUPPORT DEVICE FOR ELEVATOR

(75) Inventor: Eiji Ando, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/402,728

(22) PCT Filed: Mar. 23, 1998

(86) PCT No.: PCT/JP98/01245

§ 371 (c)(1),
(2), (4) Date: Oct. 12, 1999

(87) PCT Pub. No.: WO99/48789

PCT Pub. Date: Sep. 30, 1999

(51) Int. Cl.[7] ..... B66B 7/02; B66B 11/08
(52) U.S. Cl. ..... 187/411; 187/408; 187/414
(58) Field of Search ..... 187/406, 407, 187/408, 411, 412, 414

(56) References Cited

U.S. PATENT DOCUMENTS 3,666,051 A * 5/1972 Davis et al. ..... 187/414
4,079,816 A * 3/1978 Ohta ..... 187/411 X
5,878,847 A * 3/1999 Mustalahti et al. ..... 187/406
6,021,873 A * 2/2000 Aulanko et al. ..... 187/411
6,234,276 B1 * 5/2001 Wagatsuma et al. ..... 187/411

FOREIGN PATENT DOCUMENTS

| | | | |
|---|---|---|---|
| JP | 56-62380 | 4/1981 | |
| JP | 59-40276 | 3/1984 | |
| JP | 5-229766 A * | 9/1993 | ..... 187/408 |
| WO | WO96/09978 | 4/1996 | |

* cited by examiner

*Primary Examiner*—Eileen D. Lillis
*Assistant Examiner*—Thuy V. Tran
(74) *Attorney, Agent, or Firm*—Leydig Voit & Mayer

(57) ABSTRACT

In a rope supporting apparatus for an elevator, a column-like body along a guide rail provided within a hoist way is mounted on the guide rail through support bodies located at upper and lower ends of the guide rail. A rope end fixing member to which an end of a rope is fixed is fastened to the column-like body. The column-like body has a higher bending strength than the guide rail. Since the support bodies at both upper and lower ends of the column-like body are disposed with a sufficient distance between them, a pivoting reactive force, which is a load generated in the support bodies in a direction perpendicular to a center axis of the rail, becomes small, and any bending moment applied to the guide rail by the pivoting reactive force is smaller than the bending moment applied to the column-like body.

12 Claims, 10 Drawing Sheets

ROPE SUPPORT DEVICE FOR ELEVATOR

TECHNICAL FIELD

The present invention relates to a rope supporting apparatus for an elevator for supporting ropes for suspending a car and/or a counterweight within a hoist way.

BACKGROUND ART

FIG. 10 is a structural view showing an example of a conventional elevator. In the drawing, a hoist way 1 is formed by a steel structure 2. Also, a machine room 3 is formed in the vicinity of a bottom portion of the hoist way 1. Rope holding beams 6 and 7 are mounted on beams 4 and 5 positioned at the upper portion of the steel structure 2. Rotatable return pulleys 8 and 9 are provided on the rope holding beams 6 and 7.

A hoisting machine 10 having a sheave 11 is disposed in the machine room 3. Also, rotatable deflector sheaves 12 and 13 are provided in the machine room 3. A rope 16 for suspending a car 14 and a counterweight 15 within the hoist way 1 is laid around the sheave 11 and directed by the return pulleys 8 and 9 through the deflection sheaves 12 and 13 and is caused to pass below suspension sheaves 17 and 18 provided on the car 14 and the counterweight 15. Both end portions of the rope 16 are fixed to the rope holding beams 6 and 7 through fastening members 19, respectively.

In such an elevator, the sheave 11 is rotated forward or reversely by a drive force of the hoisting machine 10 so that the car 14 and the counterweight 15 are alternatively moved up and down within the hoist way 1.

In the example shown in FIG. 10, the hoist way 1 is formed by the steel structure 2. However, in the case where the hoist way is formed of concrete, concave/convex portions for supporting both end portions of the rope holding beams are provided on the walls of the hoist way. Then, both end portions of the rope holding beams are fixed to shoulder portions of the concave/convex portions.

However, in the above-described conventional elevator, the beams 4 and 5 or concave/convex portions for supporting the rope holding beams 6 and 7 must be provided and, in the case of the concrete structure in particular, discussions have to be held between the building designers and builders and the elevator company, and additional work for providing the concave/convex portions on the hoist way walls must be carried out. Consequently, the period of time required for construction is lengthened and at the same time, construction costs are increased.

In contrast, Hatsumei Kyokai Technical Disclosure Bulletin No. 90-9351, for example, discloses a rope end fixing device in which a member to which the end portions of a rope are fixed may be mounted on a guide rail for guiding the vertical movement of the car and/or counterweight.

FIG. 11 is a front view showing an example of a conventional rope end fixing device. In the drawing, a guide rail 21 for guiding the vertical movement of the car or the counterweight is fixed in place through a plurality of brackets 22. A rope end fixing member 24 is fixed through, for example, a plurality of support bodies 23 having bolt-and-nut assemblies. End portions of a plurality of ropes 16 are fixed to the rope end fixing member 24 through fastening members 19, respectively.

In the rope end fixing device having the support body 23 and the rope end fixing member 24, since a tension T to be applied to an end portion of each rope 16 is eccentric to a cross sectional center line C of the guide rail 21, a bending moment is applied to the guide rail 21. For this reason, it is necessary to prevent the bending moment from deforming the guide rail 21 by increasing the cross sectional area of the guide rail 21 or decreasing the spacing between the rail brackets 22, increasing the manufacturing and installation costs.

DISCLOSURE OF THE INVENTION

In order to solve the above mentioned problems, an object of the present invention is to provide a rope supporting apparatus for an elevator which is able to reduce any bending moment that applied to a guide rail.

A rope supporting apparatus for an elevator according to the present invention comprises: a column-like body extending along a guide rail installed within a hoist way and mounted on the guide rail; a rope supporting member fixed to the column-like body for supporting a rope suspending at least one of a car and a counterweight within the hoist way; and a plurality of support bodies provided between both end portions of the column-like body and the guide rail for transmitting a load from the column-like body to the guide rail.

BEST MODE FOR CARRYING OUT THE INVENTION

A preferred embodiment of the present invention will now be described with reference to the drawings.

Embodiment 1

Figure 1:
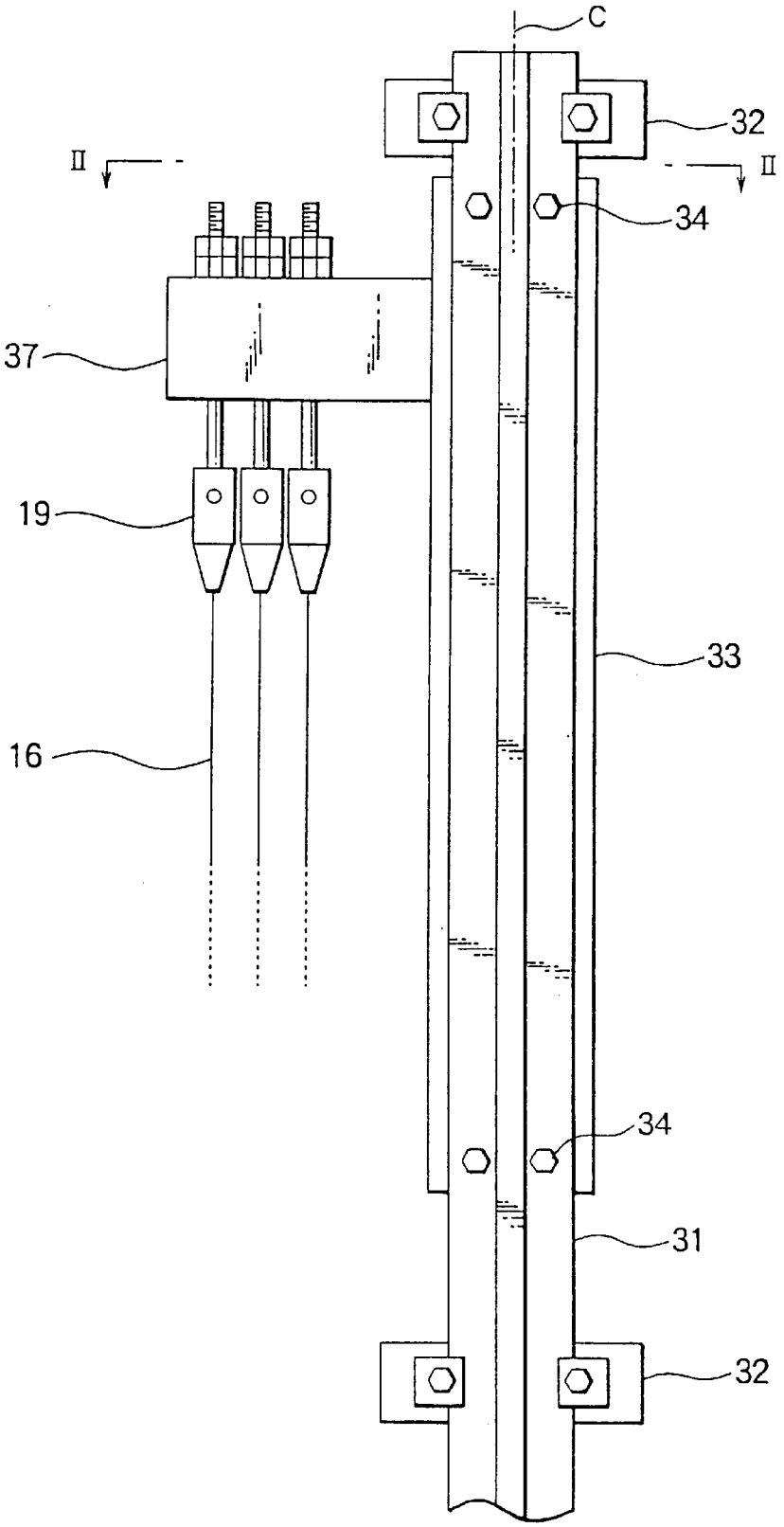
FIG. 1 is a front view showing a rope supporting apparatus for an elevator in accordance with embodiment 1 of the present invention.
Figure 2:
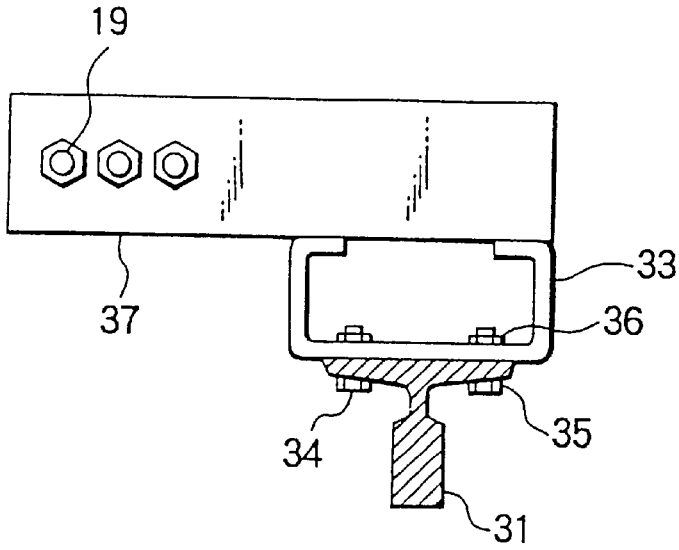
FIG. 2 is a cross-sectional view taken along the line II—II of FIG. 1.
Figure 3:
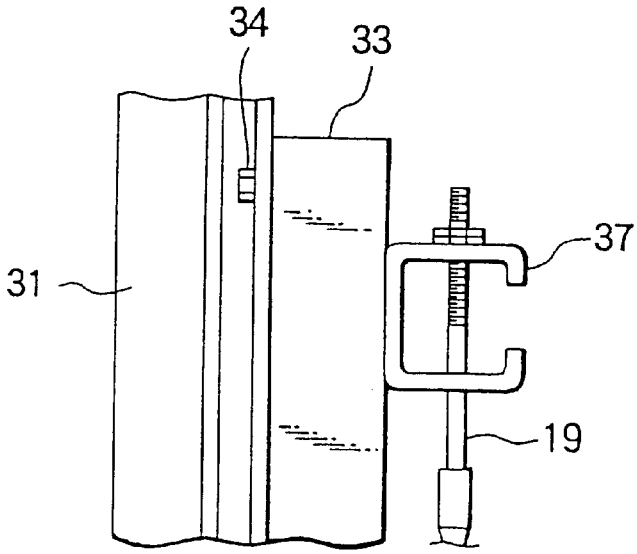
FIG. 3 is a right side elevational view showing an essential portion of the apparatus shown in FIG. 1.

FIG. 1 is a front view showing a rope supporting apparatus for an elevator in accordance with this embodiment of the invention, FIG. 2 is a cross-sectional view taken along the line II—II of FIG. 1 and FIG. 3 is a right side elevational view showing an essential portion of the apparatus shown in FIG. 1.

In the drawings, in a hoist way, a guide rail 31 for guiding the vertical movement of a car (not shown) or a counterweight (not shown) is fixed in place through a plurality of rail brackets 32. A column-like body 33 extends along a part of the guide rail 31. The depicted column-like body 33 has a tubular structure in cross-section. As shown in FIG. 2, the column-like body 33 has a generally rectangular cross-section transverse to its length with a first wall in contact with a surface of the guide rail 31, and second and third walls generally perpendicular to the first wall, and a fourth wall generally parallel to the first wall. In the depicted embodiment, the fourth wall has two parts that are separated by a gap along the length of the column-like body 33. The column-like body 33 is not limited to a tubular structure. The column-like body is mounted on the guide rail 31 through a plurality of support bodies 34 located near the ends of the column-like body 33. The support bodies 34 have bolts 35 passing through the guide rail 31 and the column-like body 33 and nuts 36 engaged with the bolts 35.

A rope end fixing member 37 having a C-shaped cross section and which is a rope support member extending in a direction perpendicular to the column-like body 33 is fixed thereto by welding or the like. End portions of a plurality of ropes 16 are fixed to the rope end fixing member 37 through fastening members 19, respectively.

Further, the column-like body 33 has a higher bending strength than that of the guide rail.

In such a rope supporting apparatus, the working center of tension applied to the ropes 16 does not correspond to the center axis C of the guide rail 33 so that the bending moment caused by the eccentric load is applied to the column-like body 33 through the rope end fixing member 37. This bending moment is transmitted to the guide rail 31 through support bodies 34. However, since the support bodies 34 at both upper and lower end portions of the column-like body 33 are arranged with a sufficient distance therebetween, the pivot reactive force, which is the load in the direction perpendicular to the rail center axis C generated in the support bodies 34 (in the right and left directions in FIG. 1) becomes smaller, and the bending moment applied to the guide rail 31 by the pivot reactive force becomes smaller than the bending moment applied to the column-like body 33.

Figure 11:
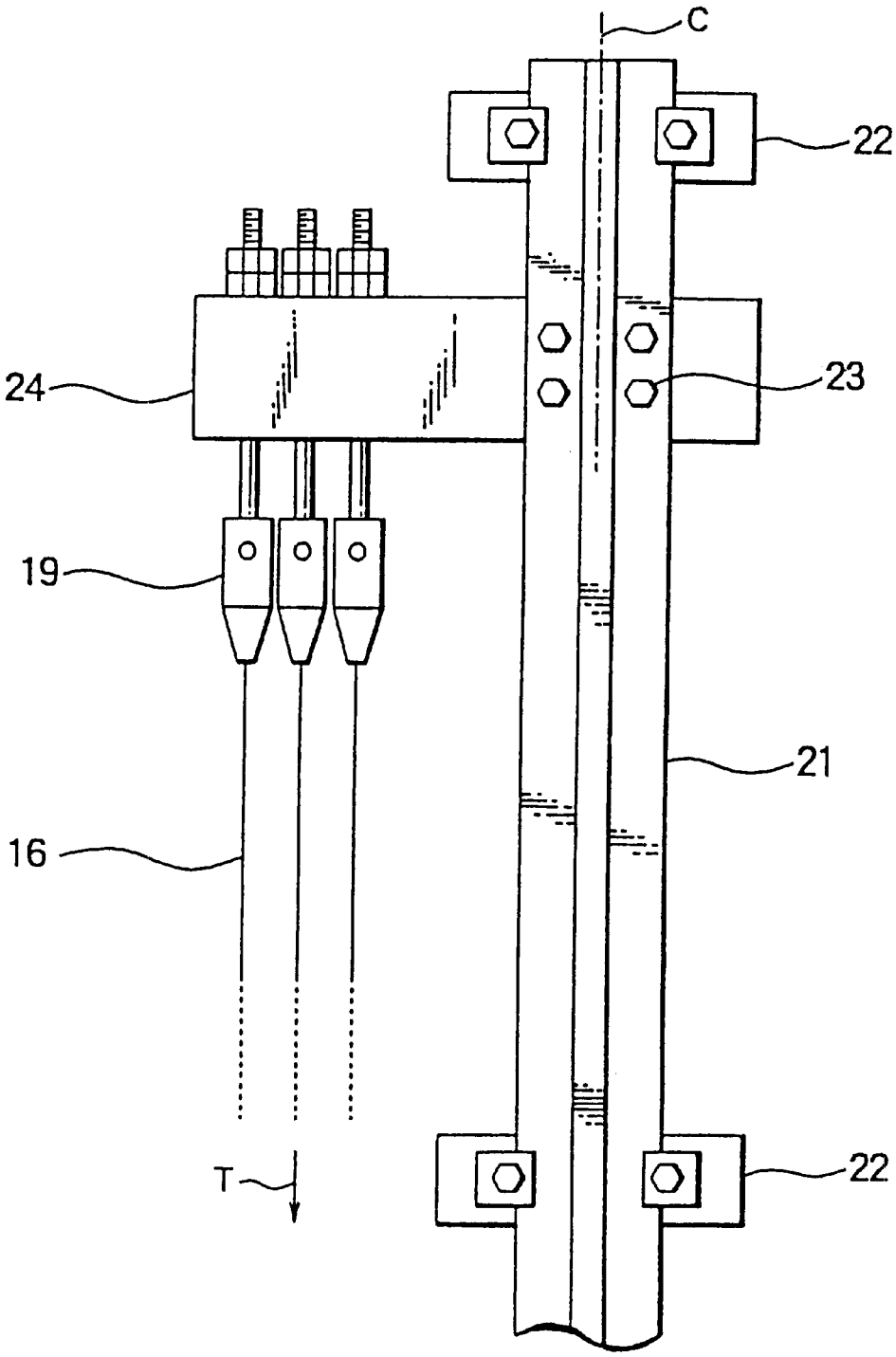
FIG. 11 PRIOR ART
FIG. 11 is a front view showing one example of a conventional rope end fixing apparatus of an elevator.

Also, the bending moment applied to the column-like body 33 is substantially the same as the bending moment applied to the guide rail 21 in the conventional apparatus shown in FIG. 11. However, the bending strength of the column-like body 33 is made higher than the bending strength of only the guide rail 31 so that sufficient strength of the rope supporting apparatus may be maintained. Accordingly, it is unnecessary to enlarge the guide rail 21 and it is possible to increase the distance between the rail brackets 32. Furthermore, it is also possible to increase the tension applied to the rope ends.

Also, since the support bodies 34 which pass through the guide rail 31 and the column-like body 33 are used, it is possible to facilitate the mounting of the column-like body 33 onto the guide rail 31 to thereby reduce manufacturing costs and shorten installation time.

Furthermore, the support bodies 34 are disposed in the vicinity of the rail brackets 32 so that the distortion is prevented from being generated in the guide rail 31 by the load from the support bodies 34.

Embodiment 2

Figure 4:
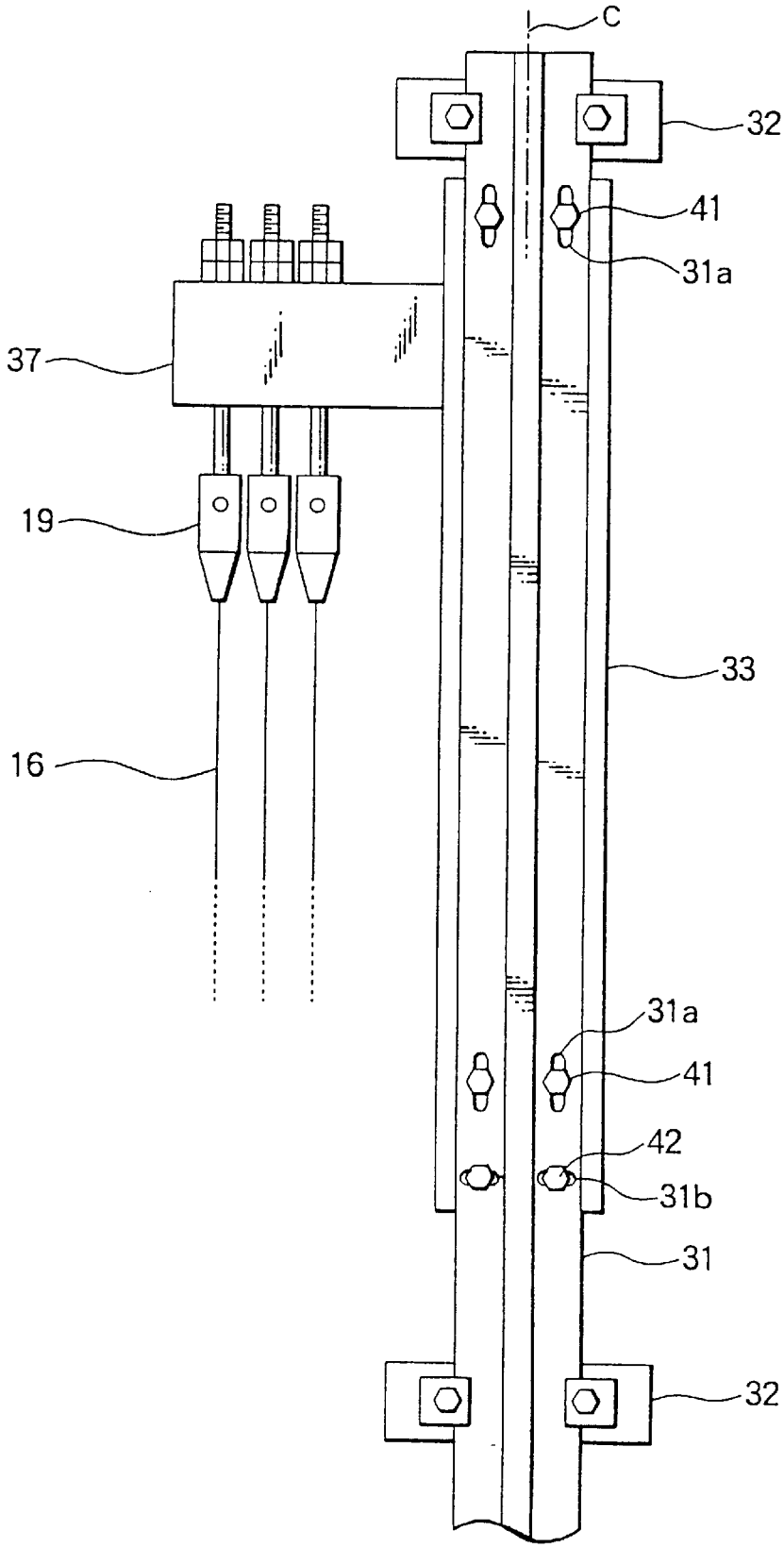
FIG. 4 is a front view showing a rope supporting apparatus for an elevator in accordance with embodiment 2 of the present invention.

Next, FIG. 4 is a front view showing a rope supporting apparatus for an elevator in accordance with embodiment of the invention. In the drawing, a plurality of first oblong holes 31*a* extending in parallel with the center axis C and a plurality of second oblong holes 31*b* extending perpendicular to the center axis C are provided in the guide rail 31.

A plurality of first support bodies 41 for mounting the column-like body 33 onto the guide rail 31 through the first oblong holes 31*a* are provided at both upper and lower end portions of the column-like body 33. These first support bodies 41 serve to transmit to the guide rail 31 only the load in the perpendicular direction to the center axis C of the guide rail 31.

A plurality of second support bodies 42 for mounting the column-like body 33 on the guide rail 31 through the second oblong holes 31*b* are provided at the lower end portion of the column-like body 33. These second support bodies 42 serve to transmit to the guide rail 31 only the load parallel to the center axis C of the guide rail 31. The other structures are the same as those of embodiment 1.

In such a rope supporting apparatus, since the first support bodies 41 at both upper and lower end portions of the column-like body 33 are arranged with a sufficient distance therebetween, the pivot reactive force generated in the first support bodies 41 becomes small. The pivot reactive force is applied to the guide rail 31 so that the bending moment applied to the guide rail 31 becomes small. Also, since the second support bodies 42 support only the load parallel to the center axis C, the pivot reactive force for supporting the bending moment is generated in only the first support bodies 41. Consequently, the bending moment applied to the guide rail 31 becomes largest at the positions of the first support bodies 41. On the other hand, the compression load is applied to a portion below the second support bodies 42 of the guide rail 31.

Accordingly, in the guide rail 31, the position where the maximum bending moment is applied is displaced from the position where the compression load is applied so that the combined stress generated in the guide rail 31 by the bending moment and the compression load may be reduced. Thus, it is possible to decrease the size of the guide rail 31 and to increase the space between the arrangement of the rail brackets 32. It is also possible to increase the tension applied to the rope ends.

Embodiment 3

Figure 5:
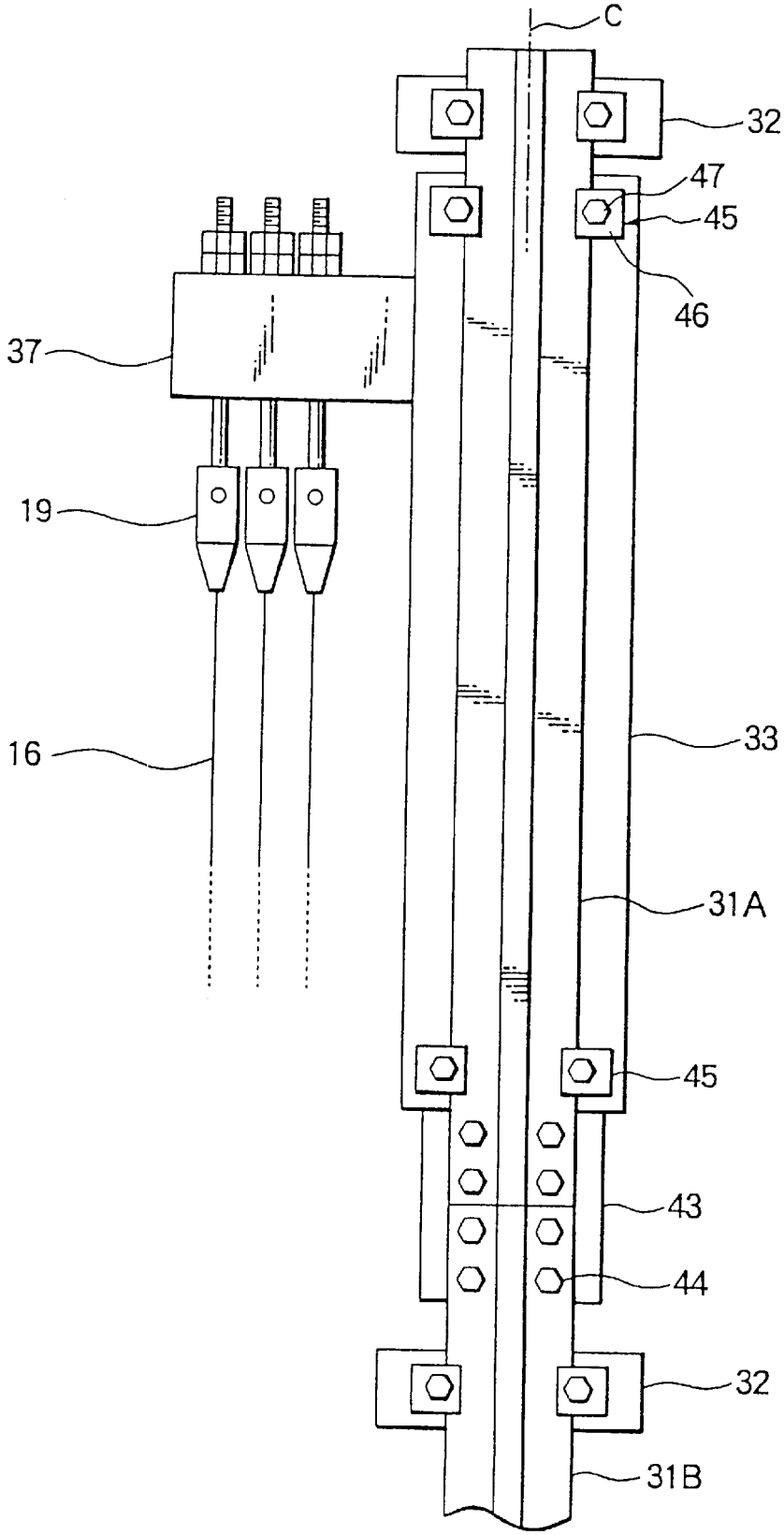
FIG. 5 is a front view showing a rope supporting apparatus for elevator in accordance with embodiment 3 of the present invention.

Next, FIG. 5 is a front view showing a rope supporting apparatus for an elevator in accordance with embodiment 3 of the present invention. In the drawing, guide rails 31A and 31B adjacent to each other in the vertical direction are connected and fixed to each other by a rail joint body 43. The rail joint body 43 is fixed to a lower end portion of the guide rail 31A and an upper end portion of the guide rail 31B by a plurality of bolts 44. The lower end portion of the column-like body 33 is in contact with the upper end portion of the rail joint body 43.

Also, the column-like body 33 is mounted on the guide rail 31 by a plurality of support bodies 45 arranged at both upper and lower end portions thereof. The support bodies 45 have rail clips 46 for clamping the guide rail 31 in cooperation with the column-like body 33 and bolts 47 for fastening the rail clips 46. Also, the support bodies 45 transmit to the guide rail 31 only the load in the direction perpendicular to the center axis C of the guide rail 31. The other structures are the same as those of embodiment 1.

In such a rope supporting apparatus, since the first support bodies 45 at both upper and lower end portions of the column-like body 33 are arranged with a sufficient distance therebetween, the pivot reactive force generated in the first support bodies 45 becomes small. The pivot reactive force is applied to the guide rail 31 so that the bending moment applied to the guide rail 31 becomes small. Also, since the load applied from the column-like body 33 to the guide rail 31 in the direction parallel to the center axis C is supported by the rail joint body 43, it is unnecessary to provide the support bodies for transmitting the load to the guide rail 31 in the direction parallel to the center axis C. Also, since the support bodies 45 having the rail clips 46 are used, it is unnecessary to provide holes in the guide rail 31 so that the time for manufacturing the guide rail 31 may be reduced and the bending strength of the guide rail 31 may be enhanced.

Furthermore, in the guide rail 31, the position where the maximum bending moment is applied is displaced from the position where the compression load is applied so that the combined stress generated in the guide rail 31 by the bending moment and the compression load may be reduced. Thus, it is possible to reduce the size of the guide rail 31 and to increase the space between the arrangement of the rail brackets 32. It is also possible to increase the tension applied to the rope ends.

Embodiment 4

Figure 6:
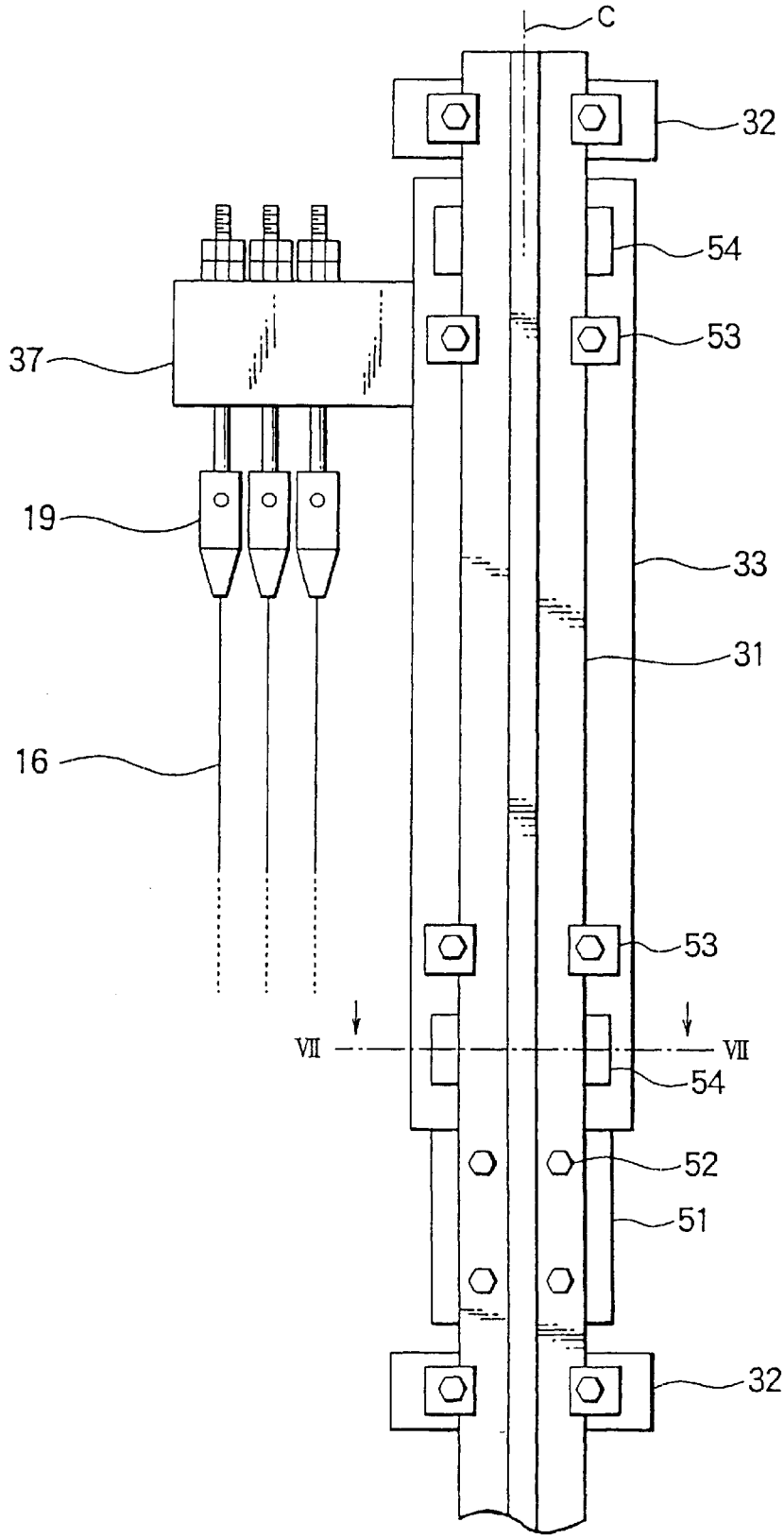
FIG. 6 is a front view showing a rope supporting apparatus for an elevator in accordance with embodiment 4 of the present invention.
Figure 7:
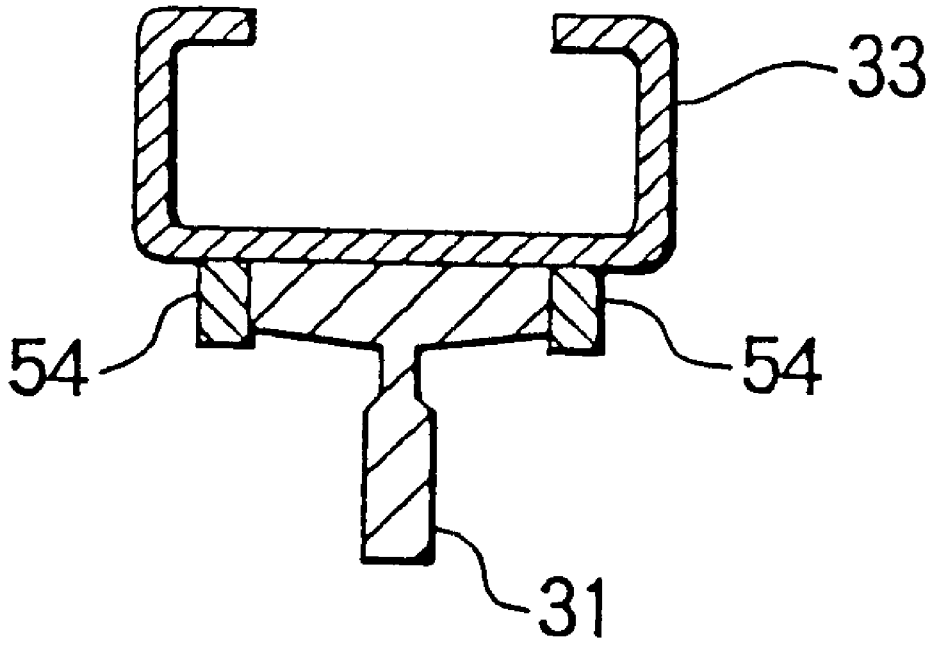
FIG. 7 is a cross-sectional view taken along the line VII—VII of FIG. 6.

Next, FIG. 6 is a front view showing a rope supporting apparatus in accordance with embodiment of the present invention. FIG. 7 is a cross-sectional view taken along the line VII—VII of FIG. 6. In the drawings, a support member 51 for supporting only the load from the column-like body 33 in a direction parallel to the center axis C is fixed to the guide rail 31 by a plurality of bolts 52. A lower end portion of the column-like body 33 is in contact with an upper end portion of the support member 51.

The column-like body 33 is mounted on the guide rail 31 by a plurality of rail clips 53. A plurality of pivot members 54 are fixed to both upper and lower end portions of the column-like body 33, respectively, as support bodies which are brought into contact with both side portions of the guide rail 31. The pivot members 54 transmit only the load from the column-like body 33 in the direction perpendicular to the center axis C to the guide rail 31. Also, in this example, the pivot members 54 are the components for transmitting the load to the guide rail 31 in the direction perpendicular to the center axis C, whereas the rail clips 53 prevent the column-like body 33 from being displaced upwardly in FIG. 7 from the guide rail 31. The other structures are the same as those of embodiment 1.

In such a rope supporting apparatus, since the pivot members 54 at both upper and lower end portions of the column-like body 33 are arranged with a sufficient distance therebetween, the pivot reactive force generated in the first pivot members 54 becomes small. The pivot reactive force is applied to the guide rail 31 so that the bending moment applied to the guide rail 31 becomes small. Also, even in the case where the rail joint body 43 is not disposed in the vicinity of the column-like body 33, as shown in embodiment 3, the load in the direction parallel to the center axis C applied from the column-like body 33 to the guide rail 31 may be received by the support member 58. Furthermore, in addition to the rail clips 53 for mounting the column-like body 33 to the guide rail 31, the pivot members 54, which can be freely designed in terms of their cross-sectional area and shape, are fixed to the column-like body 33 in order to transmit to the guide rail 31 only the load in the direction perpendicular to the center axis C of the column-like body 33. Accordingly, it is possible to maintain the strength of the pivot members 54 at a sufficient level.

Also, it is unnecessary to provide holes in the guide rail 31 so that the time for manufacturing the guide rail 31 may be reduced and the bending strength of the guide rail 31 may be enhanced. Furthermore, in the guide rail 31, the position where the maximum bending moment is applied is displaced from the position where the compression load is applied so that the combined stress generated in the guide rail 31 by the bending moment and the compression load may be reduced. Thus, it is possible to reduce the size of the guide rail 31 and to increase the space between the of the arrangement rail brackets 32. It is also possible to increase the tension applied to the rope ends.

Embodiment 5

Figure 8:
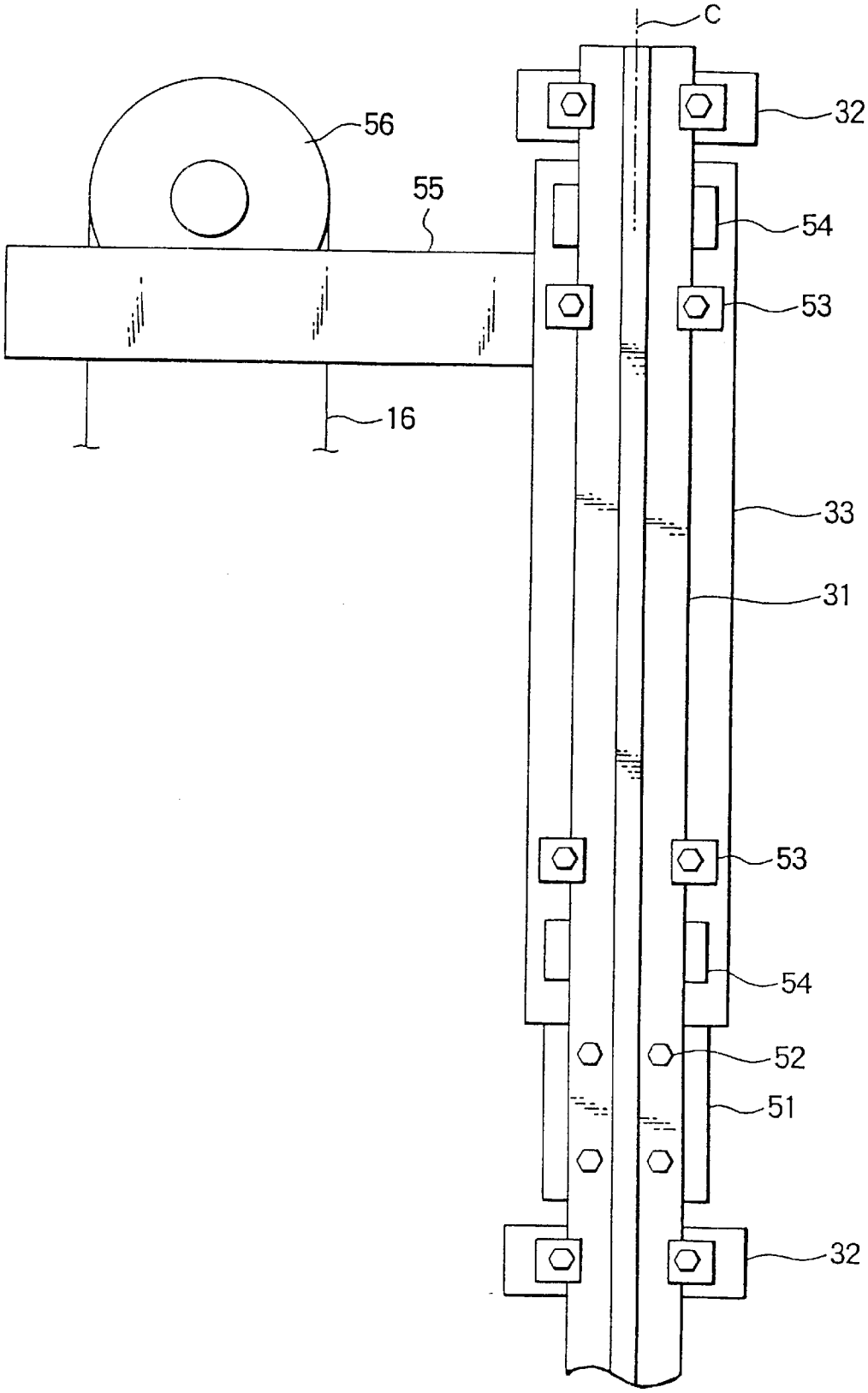
FIG. 8 is a front view showing a rope supporting apparatus for an elevator in accordance with embodiment 5 of the present invention.

Next, FIG. 8 is a front view showing a rope supporting apparatus in accordance with this embodiment of the present invention. In the foregoing embodiments, the rope end fixing member 37 to which the end portions of the ropes 16 are fixed is shown as the rope supporting member. However, in this embodiment, a return pulley support member 55 is fixed to the column-like body 33 as a rope support member. A return pulley 56 is mounted on the return pulley support member 55, and a rope 16 is wound around the return pulley.

In such an apparatus, similar to the respective foregoing embodiments, it is also possible to reduce the bending moment applied to the guide rail 31 by the tension of the rope 16, to reduce the size of the guide rail 31 and to increase the distance between the rail brackets 32.

Embodiment 6

Figure 9:
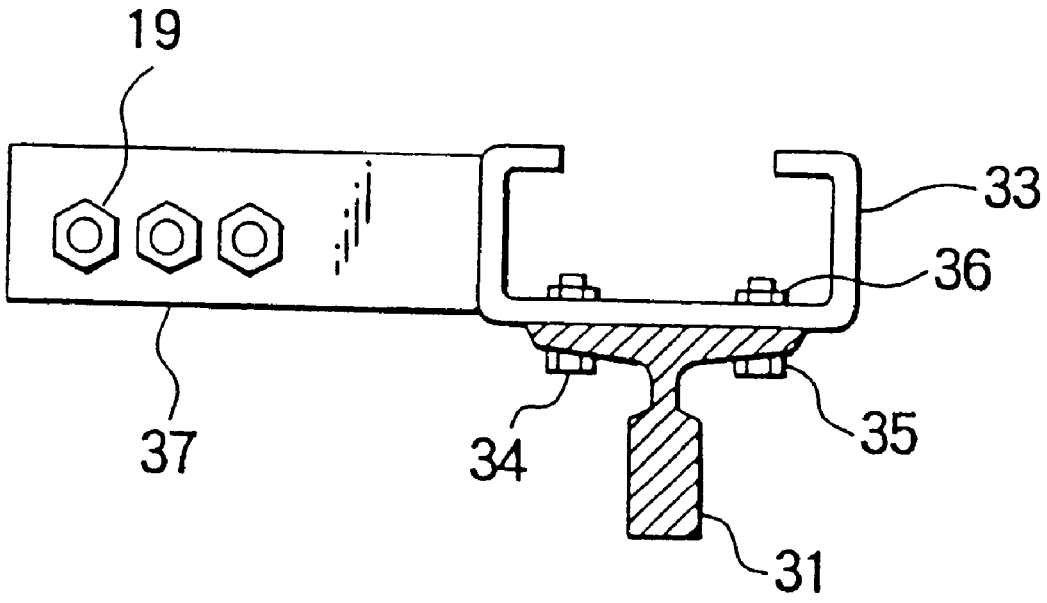
FIG. 9 is a cross-sectional view showing a rope supporting apparatus for an elevator in accordance with embodiment 6 of the present invention.
Figure 10:
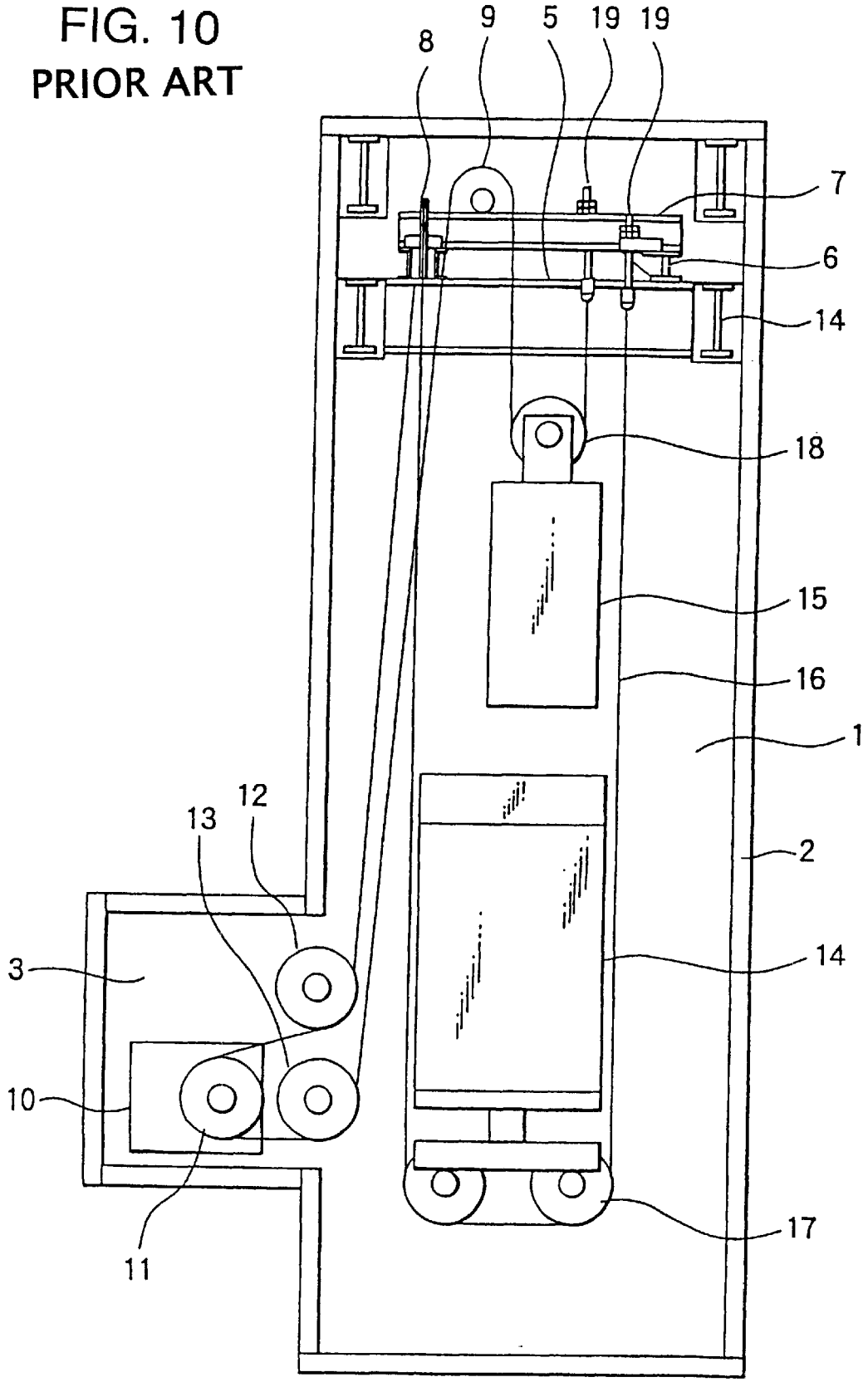
FIG. 10 PRIOR ART
FIG. 10 is a structural view showing one example of a conventional elevator.

Further, although FIG. 2 shows an example in which the rope end fixing member 37 is mounted on an opposite surface (back surface) of the guide rail mounting surface of the column-like body 33, it is also possible to mount the rope end fixing member 37 on the side surface of the column-like body 33 as shown in FIG. 9. Also, in the foregoing embodiments, even though the rope end fixing member 37 is mounted at the upper portion of the column-like body 33, it is possible to mount the rope end fixing member 37 at a central portion or lower portion, along the height of the column-like body 33.

Also, in the foregoing embodiments, the cross-sectional shape of the column-like body 33 is substantially in the form of a C, but the shape thereof is not limited thereto. It is also possible for it to have, for example, a cylindrical shape. In addition, it is also possible for the column-like body 33 to be a solid member, but it is advantageous to use a hollow member in view of weight reduction.

Furthermore, in the foregoing embodiment, the rope end fixing member 37 is fixed to the column-like body 33 by welding, but it is possible to fix it with bolts or the like. Also, it is possible to provide the rope end fixing member at the column-like body by, for example, bending a steel member in a one-piece manner.

Furthermore, it is possible to use the support bodies 45 of FIG. 5 or the pivot member 54 of FIG. 6 instead of the first support member 41 according to the second embodiment shown in FIG. 4.

Also, it is possible to install an elevator end detection switch or a mounting arm of a velocity regulator in the above-described rope supporting apparatus.

Furthermore, in the foregoing embodiment, the column-like body 33 is mounted on the guide rail 31 having a T-shaped cross section. However, the type of guide rail is not limited thereto. For instance, it is possible to use a guide rail which is formed by bending a steel plate.

Moreover, in the embodiment 1, the support bodies 34 having bolts are used but, the column-like body can be welded to the guide rail for instance and this welded portion may be used as the pivot member.

Also, although in the above-described embodiment 4, the support member 51 is fixed to the guide rail by the bolts 52, it may also be fixed by welding.

What is claimed is:

1. A rope supporting apparatus for an elevator comprising:

a guide rail mounted within a hoist way and having a center axis;

a column-like body extending along a part of said guide rail, and having upper and lower ends and a length extending between the upper and lower ends, said column-like body being mounted on said guide rail;

a rope supporting member fixed to said column-like body for supporting a rope for suspending at least one of a car and a counterweight within the hoist way, said rope supporting member having a length parallel to the center axis of said guide rail; and a load transmitting apparatus located between the upper and lower ends of said column-like body and connecting said column-like body to said guide rail for transmitting a load from said column-like body to said guide rail, and comprising first support bodies transmitting to said guide rail a load only in a direction perpendicular to the center axis of said guide rail and second support bodies transmitting to said guide rail a load only in a direction parallel to the center axis of said guide rail, wherein said first support bodies include upper supports and lower supports located below said upper supports, and said upper supports are separated from said lower supports by a distance larger than the length of said rope supporting member.

2. The rope supporting apparatus for an elevator according to claim 1, wherein said rope supporting member is a rope end fixing member to which an end portion of a rope is fixed.

3. The rope supporting apparatus for an elevator according to claim 1, wherein said column-like body has a higher bending strength than said guide rail.

4. The rope supporting apparatus for an elevator according to claim 1, wherein said second support bodies are rail clips clamping said guide rail in cooperation with said column-like body.

5. The rope supporting apparatus for an elevator according to claim 1, wherein said first support bodies comprise pivot members fixed to said column-like body in contact with two sides of said guide rail.

6. The rope supporting apparatus for an elevator according to claim 1, wherein said column-like body has a cross-section transverse to the length, the cross-section including a first wall extending along a surface of the guide rail, and second and third walls opposed to each other and extending from the first wall, whereby said column-like body has a tubular structure.

7. A rope supporting apparatus for an elevator comprising:

a guide rail mounted within a hoist way and having a center axis;

a column-like body extending along a part of said guide rail, and having upper and lower ends and a length extending between the upper and lower ends, said column-like body being mounted on said guide rail;

a rope supporting member fixed to said column-like body for supporting a rope for suspending at least one of a car and a counterweight within the hoist way, said rope supporting member having a length parallel to the center axis of said guide rail;

a load transmitting apparatus located between the upper and lower ends of said column-like body and connecting said column-like body to said guide rail transmitting a load from said column-like body to said guide rail, and comprising first support bodies transmitting to said guide rail a load only in a direction perpendicular to the center axis of said guide rail; and a support member fixed to said guide rail and in contact with the lower end of said column-like body for receiving a load only in a direction parallel to the center axis of said guide rail, wherein said first support bodies include upper supports and lower supports located below said upper supports, and said upper supports are separated from said lower supports by a distance larger than the length of said rope supporting member.

8. The rope supporting apparatus for an elevator according to claim 7, wherein said support bodies include rail clips for clamping said guide rail in cooperation with said column-like body.

9. The rope supporting apparatus for an elevator according to claim 7, wherein said first support bodies comprise pivot members fixed to said column-like body in contact with two sides of said guide rail.

10. The rope supporting apparatus for an elevator according to claim 7, wherein said rope supporting member is a rope end fixing member to which an end of a rope is fixed.

11. The rope supporting apparatus for an elevator according to claim 7, wherein said column-like body has a higher bending strength than said guide rail.

12. The rope supporting apparatus for an elevator according to claim 7, wherein said first support bodies are rail clips for clamping said guide rail in cooperation with said column-like body.

* * * * *